US009544955B2

(12) United States Patent
Huber

(10) Patent No.: US 9,544,955 B2
(45) Date of Patent: Jan. 10, 2017

(54) OPERATING CIRCUIT FOR LIGHT EMITTING DIODES AND METHOD FOR OPERATING LIGHT EMITTING DIODES

(71) Applicant: TRIDONIC GMBH & CO KG, Dornbirn (AT)

(72) Inventor: Martin Huber, Rüti (CH)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 14/365,890

(22) PCT Filed: Dec. 18, 2012

(86) PCT No.: PCT/EP2012/075880
§ 371 (c)(1),
(2) Date: Oct. 28, 2014

(87) PCT Pub. No.: WO2013/092545
PCT Pub. Date: Jun. 27, 2013

(65) Prior Publication Data

US 2015/0042237 A1 Feb. 12, 2015

(30) Foreign Application Priority Data

Dec. 19, 2011 (DE) ..... 10 2011 088 966

(51) Int. Cl.
*H05B 33/08* (2006.01)

(52) U.S. Cl.
CPC ..... *H05B 33/0815* (2013.01); *H05B 33/0818* (2013.01)

(58) Field of Classification Search
None
See application file for complete search history.

(56) References Cited

U.S. PATENT DOCUMENTS

| | | | |
|---|---|---|---|
| 8,179,110 | B2 | 5/2012 | Melanson |
| 2007/0273681 | A1 | 11/2007 | Mayell |
| 2008/0167734 | A1 | 7/2008 | Robinson et al. |
| 2008/0224625 | A1 | 9/2008 | Greenfeld |
| 2010/0079124 | A1 | 4/2010 | Melanson |
| 2010/0148683 | A1 | 6/2010 | Zimmerman |
| 2011/0109247 | A1 | 5/2011 | Hoogzaad et al. |
| 2011/0115399 | A1 | 5/2011 | Sadwick et al. |

(Continued)

FOREIGN PATENT DOCUMENTS

| | | | |
|---|---|---|---|
| CN | 101080119 | A | 11/2007 |
| CN | 102217417 | A | 10/2011 |

(Continued)

*Primary Examiner* — Douglas W Owens
*Assistant Examiner* — Jianzi Chen
(74) *Attorney, Agent, or Firm* — Volpe and Koenig, P.C.

(57) ABSTRACT

The invention relates to a method for the operation of at least one light emitting diode (5, 6) by means of a switching regulator circuit (20) preferably designed as a step-down converter, to which an input voltage (VDC) is supplied and which provides, by means of at least one switch (1) clocked by a control unit (10), an output voltage (VOUT) for the supply of the at least one light emitting diode (5, 6) with current that is regulated to be constant at least in the temporal average, wherein the setpoint for the LED current is adjustable for the dimming, wherein the regulation parameters for the regulation loop for the LED current are changed depending on the operating mode of the switching regulator circuit (20).

14 Claims, 5 Drawing Sheets

(56) References Cited

U.S. PATENT DOCUMENTS

| | | | |
|---|---|---|---|
| 2011/0241569 | A1 | 10/2011 | Zimmermann et al. |
| 2012/0119669 | A1 | 5/2012 | Melanson et al. |

FOREIGN PATENT DOCUMENTS

| | | | |
|---|---|---|---|
| CN | 102232264 | A | 11/2011 |
| DE | 102007028785 | A1 | 12/2008 |
| DE | 102007049533 | A1 | 4/2009 |
| DE | 102008057333 | A1 | 5/2010 |
| WO | 2010118944 | A1 | 10/2010 |
| WO | 2011076898 | A1 | 6/2011 |

OPERATING CIRCUIT FOR LIGHT EMITTING DIODES AND METHOD FOR OPERATING LIGHT EMITTING DIODES

FIELD OF THE INVENTION

The present invention relates to a circuit and to a method for operating one or more light-emitting diodes (LEDs) by means of switching regulators for providing an operating current for the LEDs.

BACKGROUND

For the operation of LEDs, it is in principle already known to use an operating circuit comprising switching regulators. For example, switching regulators such as buck converters or step-down converters, boost converters or step-up converters, flyback converters etc. can be used for driving LEDs. In this case, a control unit drives a clocked semiconductor power switch, by means of which, in the switched-on state of said semiconductor power switch, an inductance is magnetized, wherein, in the switched-off state of the switch, the inductance is then discharged or demagnetized via the LEDs, for example.

The switch can be controlled by the control unit via pulse width modulation (PWM). It is known in particular to use a constant radiofrequency frequency of the order of magnitude of, for example, 100 kHz for the PWM control signal. By selecting a corresponding duty cycle of the PWM control signal, dimming of the LEDs can then be made possible.

Furthermore, the use of operating circuits which support regulation of, for example, the power supplied to the LEDs or the current supplied to the LEDs is known for regulated operation of LEDs. Such regulation requires a fed-back measured variable, which can reproduce directly or indirectly, for example, the voltage drop across the LEDs and/or the current flowing through the LEDs.

In the case of regulation of the LED current, a regulator is used to attempt to keep the current through the LEDs constant. An operating circuit comprising such regulation should also be usable for different LED loads.

One problem with such regulation, however, consists in the fact that the regulation behavior can change depending on the LED load and depending on the dimming value, for example. One disadvantage here consists in the varying behavior of the regulator in respect of stability and temporal response, for example.

Therefore, the object of the present invention consists in providing an operating circuit for at least one light-emitting diode and a method for operating at least one light-emitting diode which improves the regulation of the current, voltage or electric power supplied to the LED even when different LED loads are connectable.

SUMMARY

This object is achieved according to the invention by the features of the independent claims. The dependent claims develop the central concept of the invention in a particularly advantageous manner.

In accordance with a first aspect of the invention, a method is provided for operating at least one light-emitting diode by means of an actively clocked switching regulator circuit, which is in the form of a buck converter, for example, and to which an input voltage is supplied, and which provides, by means of at least one switch clocked by a control unit, an output voltage for supplying the at least one light-emitting diode. An actual value signal, which reproduces directly or indirectly the current (or the temporal mean value thereof) through the LED(s), the voltage across the LED(s) or the electric power supplied to the LED(s), is fed back to the switching regulator circuit, said actual value signal being compared with a current, voltage or power setpoint value. Thus, a control loop is formed whose controlled variable is the clocking of the switch. The properties of the control loop are in this case dependent on the operating mode of the switching regulator circuit. Typically, the regulation is a hysteresis regulation, in which, in the case of current regulation, the LED current fluctuates cyclically between two values.

The control algorithm can be implemented in analog or digital form. In particular in the case of a digital implementation, the variation of the properties of the control loop preferably takes place by changing the parameters of the digitally implemented regulation. Meanwhile, the change to the properties can also be implemented at another point in the control loop, for example by selective switching of a bandpass filter, for example, in the feedback branch of the actual value signal.

In accordance with a further aspect of the invention, an operating circuit is provided for at least one light-emitting diode, having a switching regulator circuit to which an input voltage is supplied and which provides, by means of at least one switch clocked by a control unit, an output voltage (current) for supplying the at least one light-emitting diode. The control parameters are dependent on the operating mode of the switching regulator circuit, for the regulation of the output current, the output voltage and the output electric power.

Advantageously, in the event of a transfer from one operating mode of the switching regulator circuit to another operating mode, the control parameters can be changed.

Advantageously, the operating mode of the switching regulator circuit can be identified. The control parameters can be adjusted depending on this.

Advantageously, different control parameter sets can be provided for different operating modes.

Advantageously, the switching regulator circuit can be operated in a continuous mode and/or in a discontinuous mode. A respective control parameter set can be provided for each of these operating modes.

The discontinuous operating mode can be identified by virtue of the fact that, when the switch is switched off, a reversal of or an increase in the output voltage of the switch is determined. Alternatively, the discontinuous operating mode can be identified by virtue of the fact that, when the switch is switched off, a reversal of or an increase in the voltage drop across a diode connected downstream of the switch is determined. Alternatively, the discontinuous operating mode can be identified by virtue of the fact that, when the switch is switched off, a reversal of or an increase in the voltage drop across an energy store of the switching regulator circuit is determined.

The discontinuous operating mode can also be identified by virtue of the fact that, when the switch is switched on, the output voltage of the switch or the voltage drop across a diode connected downstream of the switch or the voltage drop across an energy store of the switching regulator circuit is greater than a predetermined value, for example zero, or is within a specific value range.

Preferably, an operating mode or a transfer between two operating modes can be determined by means of a flipflop circuit.

The flipflop circuit can advantageously be configured in the form of a D flipflop circuit. The clock input of the D flipflop circuit can be fed the control signal generated by the control unit for the switch. The D input of the D flipflop circuit can be fed a signal which represents an electrical parameter of the switching regulator circuit. The output of the D flipflop circuit can be connected to an input of the control unit.

Preferably, the signal at the D input of the D flipflop circuit can reproduce the output voltage of the switch of the switching regulator circuit in the form of a buck converter.

The control signal for the switch at the clock input can be delayed such that the runtimes of the switch driving are compensated for.

Advantageously, in order to identify the operating mode, a comparator can be connected at the D input.

Preferably, the adjustment of the control parameters can be made dependent on the fact that, in a continuous operating mode of the switching regulator circuit, the steady-state gain is greater than in a discontinuous operating mode.

Preferably, the switch can be clocked by means of pulse width modulation driving by the control unit.

In accordance with a further aspect of the invention, an integrated circuit is provided, preferably in the form of a microcontroller, an application-specific integrated circuit (ASIC) or a digital signal processor. The integrated circuit is configured so as to implement the method.

In accordance with a further aspect of the invention, a luminaire is provided. The luminaire has the integrated circuit or the operating circuit.

In accordance with one concept of the invention, the regulator is adaptive in the sense that, for the continuous operating mode (continuous conduction mode), on the one hand, and the critical/discontinuous operating mode (borderline/discontinuous conduction mode), on the other hand, said regulator has two different control parameter sets.

Control parameters are adjusted on the basis of the operating mode in order to compensate for the various steady-state gains of the buck converter or the controlled system.

In order to be able to implement the changeover of the control parameters, the state in which the switching regulator circuit or the converter is currently at is preferably determined. This can be performed, for example, by virtue of the fact that, at the switch-on time of the switch of the buck converter, the current through the inductance or through the LEDs or an electrical variable dependent thereon is determined. In the continuous operating mode, an LED current flows at the switch-on time of the switch. This is naturally not the case in the critical operating mode or in the discontinuous operating mode.

The advantage of the invention consists in that the different gradients of the string characteristic of the LED load are taken into consideration in the regulation. Firstly, the regulation can be very stable in the region of a high gradient of the string characteristic. Secondly, the regulation can also quickly be sufficient for the region of the string characteristic with a flat profile.

BRIEF DESCRIPTION OF THE DRAWINGS

Further features, advantages and properties of the present invention will now be explained with reference to the figures in the attached drawings and the detailed description of exemplary embodiments. In the drawings:

FIG. 6 shows an operating circuit for light-emitting diodes in accordance with yet a further exemplary embodiment of the present invention.

DETAILED DESCRIPTION OF THE PREFERRED EMBODIMENTS

NB: Even when the invention is explained on the basis of current regulation below, it should be understood that the invention can likewise be applied to voltage regulation or power regulation.

In the case of voltage regulation, at least one parameter reproducing the LED voltage is fed back and compared with a setpoint value. Correspondingly, in the case of LED power regulation, one or preferably more parameters reproducing the LED power, preferably combinatorially, i.e. by a plurality of parameters being set in relation to one another, is fed back and then compared with a setpoint value.

Figure 1:
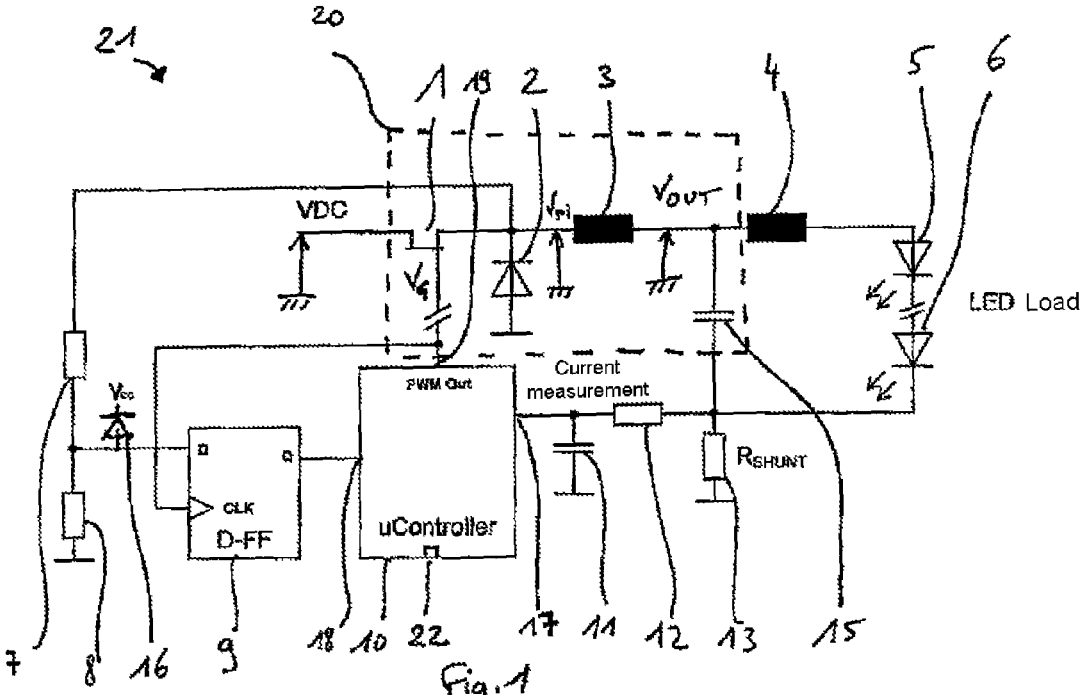
FIG. 1 shows an operating circuit for light-emitting diodes in accordance with an exemplary embodiment of the present invention.

FIG. 1 shows schematically an exemplary embodiment of an operating circuit 21 according to the invention for light-emitting diodes 5, 6.

An operating circuit in accordance with the present invention comprises a converter for providing an output voltage and an output current for the light-emitting diodes 5, 6. The converter can also be referred to as switching regulator, in which the supply of current to the light-emitting diodes is ensured by means of a periodically operating electronic switch and at least one energy store the supply of current to the light-emitting diodes.

The operating circuit 21 shown in FIG. 1 comprises a switching regulator in the form of a buck converter 20. The buck converter 20 comprises a switch 1, a diode or rectifier diode 2, an inductance 3 and a capacitor or smoothing capacitor 15. For the operation of at least one light-emitting diode 5, 6, an input voltage VDC is supplied to the buck converter 20. This input voltage VDC is preferably a DC voltage, but can alternatively also be an AC voltage or a rectified AC voltage.

The input voltage VDC feeds a first input of the switch 1, which can be configured, for example, as a field-effect transistor (FET) or semiconductor power switch, in particular MOSFET. The switch 1 is switched on and off via a control input, preferably by means of a PWM signal VG. The output of the switch 1 is connected to the cathode of the diode 2. The diode 2 is connected on the anode side to ground. At the node between the output of the switch 1 and the cathode of the diode 2, the inductance 3 is connected. The capacitor 15 is connected between ground or shunt resistor and the other connection of the inductance 3.

The role of the previously mentioned energy store is taken on by the inductance 3, in which the switch 1, in the switched-on state, generates an output-side voltage VM which is greater than the output voltage VOUT of the buck converter 20. During the switch-on phase of the switch 1, the current through the inductance 3 thus increases.

During a subsequent freewheeling phase or blocking phase, the switch is switched off. This results in the output voltage VM of the switch decreasing. There is now a negative voltage present at the inductance 3, with the result that the current through this inductance 3 decreases linearly again and the stored electrical energy is passed on to the light-emitting diodes 5, 6.

A series circuit comprising an inductance 4 and at least one light-emitting diode 5, 6 is provided at the output of the buck converter 20. The series circuit comprising the inductance 4 and the light-emitting diodes 5, 6 is connected in parallel with the capacitor 15. The inductance 4, together with the capacitor 15, forms an output filter.

In the exemplary embodiment in FIG. 1, a plurality of light-emitting diodes 5, 6 is connected in series. Alternatively, the operating circuit 21 can be used for only one light-emitting diode. Alternatively, the light-emitting diodes can also be connected in parallel. Preferably, the light-emitting diodes can also be arranged in accordance with a series and parallel circuit. The light-emitting diodes can be OLEDs. Furthermore, they may be, for example, monochromatic light-emitting diodes, dye-converted white light-emitting diodes and/or RGB light-emitting diode modules. In the latter case, it is particularly advantageous if each luminescent paint is arranged in a separate light-emitting diode string ("light-emitting diode channel").

As an alternative to the buck converter 20, an operating circuit according to the invention can also include a boost converter (not shown), for example. The buck converter generates at its output an output voltage VOUT which is lower than the DC input voltage (VDC). With a boost converter, on the other hand, a higher output voltage VOUT is generated.

A shunt resistor or measuring resistor 13 is connected to the node between the capacitor 15 and the light-emitting diodes 5, 6. The other connection point of the shunt resistor 13 is connected to ground. The voltage drop across the shunt resistor 13 is a measured variable for the total current flowing through the light-emitting diodes.

Preferably, a low-pass filter is connected downstream of the shunt resistor 13. In accordance with the exemplary embodiment shown in FIG. 1, the low-pass filter is in the form of an RC filter comprising a resistor 12 and a capacitor 11. Owing to the low-pass nature of the RC filter, the series circuit comprising the measuring resistor 13 and the RC filter results in the mean value of the voltage drop across the measuring resistor 13 being formed at the output of the RC filter. The output of the RC filter is supplied to a measuring input 17 of the control unit 10, with the result that the control unit 10 provides an actual value for the current through the light-emitting diodes.

Preferably, a mean value of the current through the light-emitting diodes 5, 6 is fed back to the control unit 10. Alternatively, the signal at the measuring input 17 can also reproduce the instantaneous value for the current through the light-emitting diodes 5, 6. In this case, the control unit 10 can preferably initiate the averaging of the light-emitting diode current internally.

The control unit 10 is designed to preset the clocking of the switch 1, for example in the form of PWM-modulated or pulse-width-modulated signals at the output 19 as manipulated variable for the regulation of the light-emitting diode power.

As feedback signal used for the regulation (and which is compared with a setpoint value, for example), at least the current which flows through the light-emitting diode string 5, 6 is measured. This measurement is performed at the input 17. This light-emitting diode current can in this case be measured at any desired point in the light-emitting diode current path. As shown in FIG. 1, the light-emitting diode current can be measured, in particular using the measuring resistor 13, and then preferably averaged.

If a plurality of parallel light-emitting diode strings are arranged (not shown), it is advantageous if each light-emitting diode string is regulated via a dedicated feedback signal, which reproduces the current flowing in the light-emitting diode string, for example.

A dimming value supplied via the input 22 to the control unit 10 externally can be used as a setpoint value for the regulation. This may be analog dimming via amplitude variation, for example. Alternatively, a digital dimming value can be taken into consideration, which is communicated via a digital data bus (see FIG. 7), for example.

The operating circuit according to the invention is an adjustable current source, for example of 1% to 100% for different light-emitting diode loads, for example from 14 V to 44 V. The buck converter 20 is preferably driven by means of PWM via a control unit 10 in the form of a microcontroller. Preferably, a constant RF PWM frequency of, for example, 100 kHz is selected in order that the output filter can be provided with optimum dimensions for reducing current ripple. As a result, the buck converter 20 operates in the continuous operating mode, the critical operating mode or the discontinuous operating mode, depending on the working point.

The light-emitting diode current is preferably kept constantly at a desired current level by a digital PI controller in the control unit 10 or in the microcontroller. Up to approximately 10% light-emitting diode current, dimming preferably takes place continuously in analog form. Then, the light-emitting diode current is modulated to 1% with an LF PWM of, for example, 312 Hz in order keep the effective light-emitting diode current at a minimum of 10%. Thus, relatively great shifts in color locus can be avoided and no disruptive stroboscopic effects occur up to 10% LED current.

Figure 2:
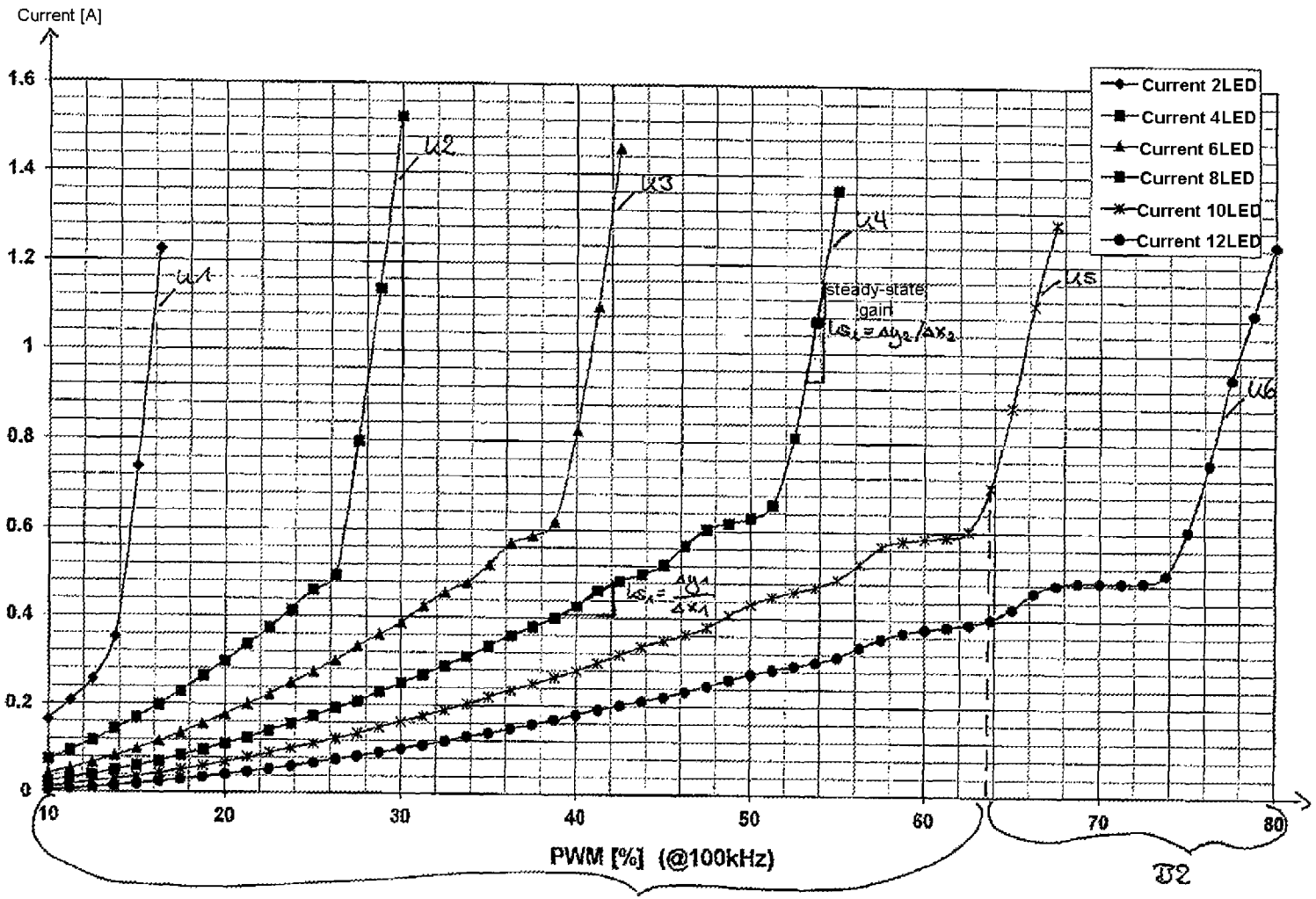
FIG. 2 shows the regulated current profile of the current through a light-emitting diode string as a function of a desired dimming value.

The regulated current profile of the current through the light-emitting diode string is shown in FIG. 2. In FIG. 2, for this purpose, the dimming value or the duty cycle of the PWM signal is illustrated along the X axis, and the light-emitting diode current is illustrated along the Y axis. The current plotted over the switch-on duration of the switch 1 of the buck converter 20 is illustrated. The different characteristics K1, K2, K3, K4, K5, K6 relate to different loads.

It is demonstrated that, depending on the degree of dimming, which is determined, for example, via amplitude variation in the case of analog dimming, and the load, the characteristic for the load has in particular two sections with different gradients.

For example, in the case of the characteristic K4, two regions with different gradients are discernible. In a first region B1, the gradient is flatter than in a second region B2. The duty cycle in the second region B2 is greater than in the first region B1. These two sections with different gradients reflect in particular that, depending on the degree of dimming and the light-emitting diode load, the converter can be in the continuous operating mode (continuous conduction mode) or in the critical or discontinuous operating mode (borderline or discontinuous conduction mode). The frequency of the control of the switch 1 in this case preferably remains constantly in the radiofrequency range.

In respect of the regulation properties, in particular the time constants for the regulation, the regulator can be improved to the extent that it has different control parameter sets depending on the state of the converter. The control parameter sets are in particular matched to these respective very different string characteristics. Different control parameter sets are provided for different operating modes of the converter.

The adjustment of the control parameters can be performed in a known manner depending on the steady-state gain ks. The steady-state gain ks corresponds to the gradient of the characteristics shown in FIG. 2.

As can be seen from FIG. 2, the steady-state gain ks increases considerably at relatively high light-emitting diode currents. Prior to this increase, there is even still a very flat point with an extremely small gain. This behavior is brought about by the transition from the continuous operating mode to the discontinuous operating mode and is disadvantageous in terms of regulation technology.

The solution according to the invention whereby the control parameters are adjusted depending on the operating state of the switching regulator circuit ensures that the regulator can firstly still operate stably in the continuous mode in the case of very great steady-state gains and in particular at a duty cycle in the vicinity of 100%. Secondly, the control parameters can also be adjusted separately in the discontinuous mode, with the result that the regulation is no longer sluggish. In contrast, this adjustment results in a rapid adjustment to the setpoint value taking place even in the discontinuous operating mode and at relatively low currents. A further advantage consists in that the ripple of the characteristics in the lower current range is no longer visible.

By virtue of the adjustment of the control parameters depending on the operating mode, very stable regulation in the region of the high gradient of the string characteristic and secondly quick regulation for the region of the string characteristic which has a flat profile are possible.

The adaptive regulator according to the invention will adjust its parameters depending on the working point. For this purpose, it should be identified when the transition between the discontinuous operating mode and the continuous operating mode is since, at this transition, a significant change in the steady-state gain ks was identified. However, this point differs greatly depending on the light-emitting diode load and on component tolerances and makes switchover of the regulator, for example by means of current measurement and/or duty cycle, rather imprecise.

Figure 3:
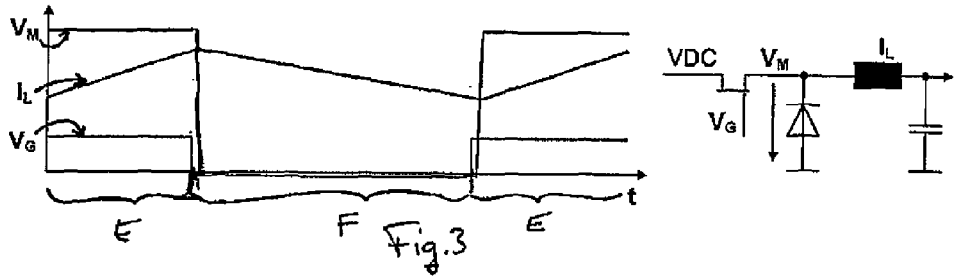
FIG. 3 shows a detailed view with respect to the current profile of the current through the light-emitting diode string in a first operating mode of the operating circuit.

FIG. 3 shows a detailed view with respect to the current profile of the current through the light-emitting diode string in the continuous operating mode of the operating circuit. The figure also shows the profile of the control signal VG for the switch 1 and the voltage VM at the output of the switch 1. In the switch-on phase E of the switch 1 defined by the control signal VG, the voltage VM assumes a positive value and the current through the inductance IL increases linearly. If the control signal VG assumes the value zero, the voltage VM decreases approximately to the value −0.7 V. During this freewheeling phase F or blocking phase, the current through the inductance 3 decreases linearly, but does not go back to zero. During subsequent switch-on of the switch 1, the voltage VM again assumes the positive value in pulsed fashion.

Figure 4:
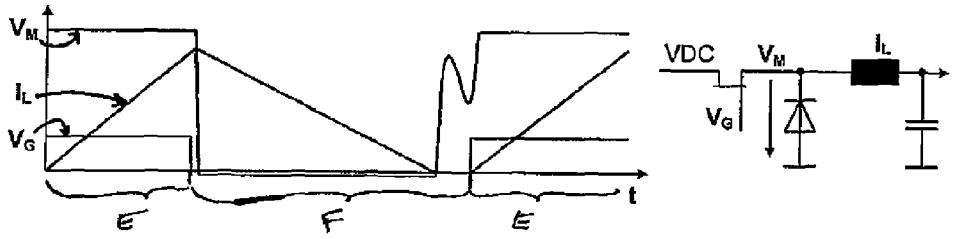
FIG. 4 shows a detailed view with respect to the current profile of the current through the light-emitting diode string in a second operating mode of the operating circuit.

FIG. 4 shows the current profile of the current through the light-emitting diode string in the discontinuous operating mode of the operating circuit. In the freewheeling phase F, the current through the inductance 3 decreases to zero. At the time at which the current through the inductance becomes zero, the voltage VM jumps to the value VOUT. A resonant circuit is formed, which is excited by the voltage jump at the diode 2. The voltage VM develops in accordance with a decaying oscillation around a positive value.

In accordance with the invention, the operating mode is detected by the drive signal VG and the voltage VM. For this purpose, a D flipflop circuit 9 is provided, which is clocked with the positive drive edge of the control signal VG. As is shown in FIG. 1, the clock input of the flipflop circuit is connected to the control signal VG, generated by the control unit 10, for the switch 1.

The data or D input of the D flipflop circuit 9 is connected to the center point VM of the buck converter via a voltage divider 7, 8. The output of the D flipflop circuit 9 is connected to an input 18 of the control unit 10.

In this exemplary embodiment, the detection of the operating mode is implemented by means of the D flipflop 9, which is clocked in synchronism with the clocking of the buck converter switch 1. A signal which reproduces the bridge voltage VM is fed to the D input of the D flipflop.

Optionally, a diode 16 can be provided at the D input of the D flipflop circuit 9. The anode of the diode is connected to the center point of the voltage divider comprising two resistors 7, 8. The anode of the diode 16 is connected at the D input of the D flipflop circuit 9. The cathode of the diode 16 is connected to a positive voltage VCC. The present operating mode is always output at the output of the flipflop 9.

The identification of the operating mode takes place by means of the D flipflop circuit 9. In the case of a positive drive edge of the control signal VG and in the continuous operating mode, the voltage VM has the value zero or −0.7 V. The output of the flipflop circuit 9 thus assumes the logic state 0, which is detected by the control unit 10. In turn, said control unit concludes that there is the continuous operating mode and, in accordance with the invention, takes into consideration the control parameters provided correspondingly for this operating mode for the light-emitting diode regulation. These control parameters are adjusted to the high steady-state gain of the continuous operating mode.

In the discontinuous operating mode, on the other hand, the voltage VM is no longer approximately −0.7 V during driving of the switch 1. This voltage VM is much higher than the required one level voltage of the D input at the time of switch-on. The output of the flipflop therefore outputs the logic state 1. The control unit therefore concludes that there is a discontinuous operating mode and adjusts the control parameters correspondingly.

On the basis of the output signal of the flipflop 9, the control unit 10 can now adjust the parameters of the regulator in order to compensate for the various steady-state gains of the controlled system.

Advantageously, a delay (for example RC) can be built in at the clock input of the flipflop circuit 9 (this is not shown) in order to compensate for the runtimes of the switch driving.

Figure 5:
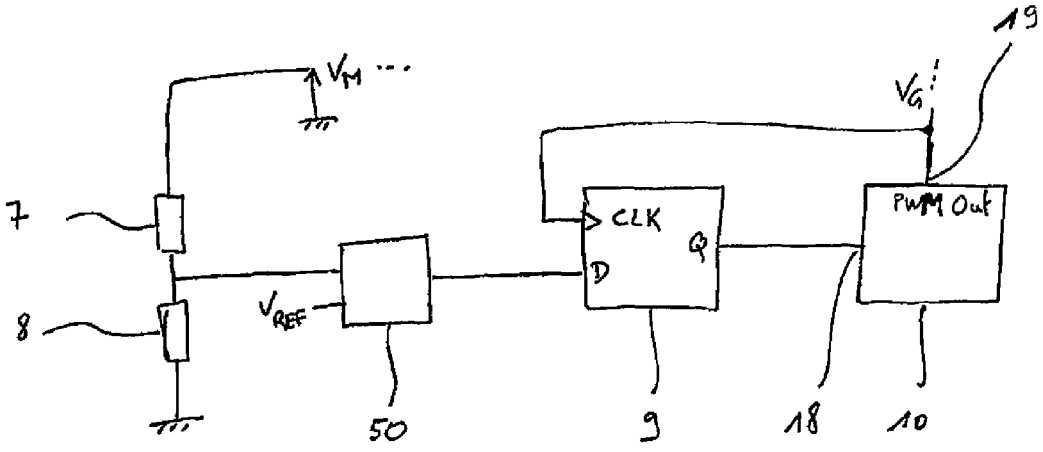
FIG. 5 shows an operating circuit for light-emitting diodes in accordance with a further exemplary embodiment of the present invention.
Figure 5:
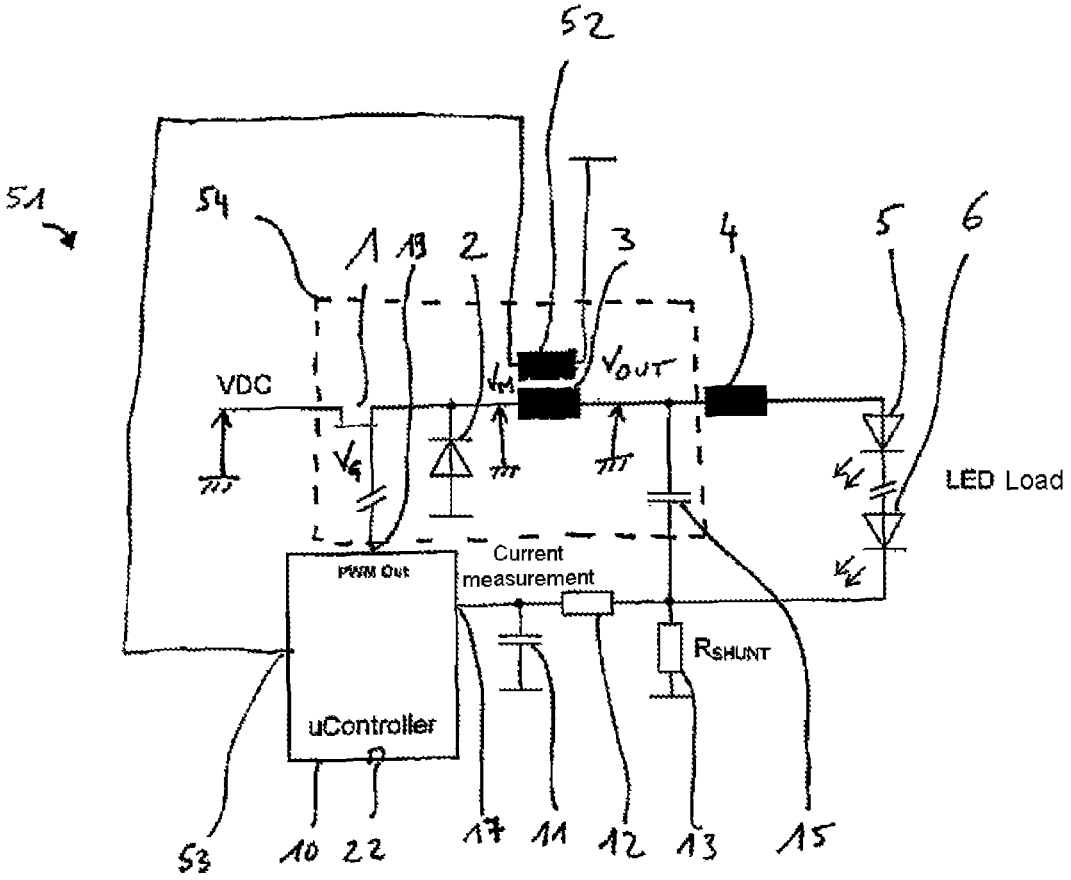

FIG. 5 illustrates a detail of a modification of the circuit shown in FIG. 1. The only difference in relation to the circuit shown in FIG. 1 is a comparator 50, which is connected upstream of the D input of the flipflop 9. By adjusting a reference value VREF, which is compared with the signal from the voltage divider 7, 8, the identification of one or the other operating mode by the control unit 10 can thus be determined more precisely. The comparator can be advantageous in particular for a lower switching level or in the case of excessively small voltage gradients of the voltage VM.

FIG. 6 shows a further exemplary embodiment of an operating circuit 51 in accordance with the present invention. Component parts which are identical to component parts shown in FIG. 1 have been provided with identical reference symbols, with the result that a repetition of the description of these component parts can be dispensed with.

The buck converter 54 corresponds to the buck converter 20 shown in FIG. 1, with the difference that a secondary winding 52 is now provided. This secondary winding 52 is magnetically coupled to the inductance 3 of the buck converter 20. The voltage at the secondary winding 52 is supplied to an input 53 of the control unit 10.

The voltage present at the secondary winding 52 and measured by the control unit 10 is proportional to the voltage VM-VOUT of the inductance 3, wherein the voltage VOUT is preferably constant. The voltages at the secondary winding 52 and at the inductance 3 therefore have the same behavior in relation to one another as the numbers of turns of the two electrical components.

Optionally, this voltage which is present at the inductance can be supplied to a D flipflop circuit 9, as shown in FIG. 1, wherein the output of the D flipflop circuit 9 reproduces the operating state of the buck converter 20.

Figure 7:
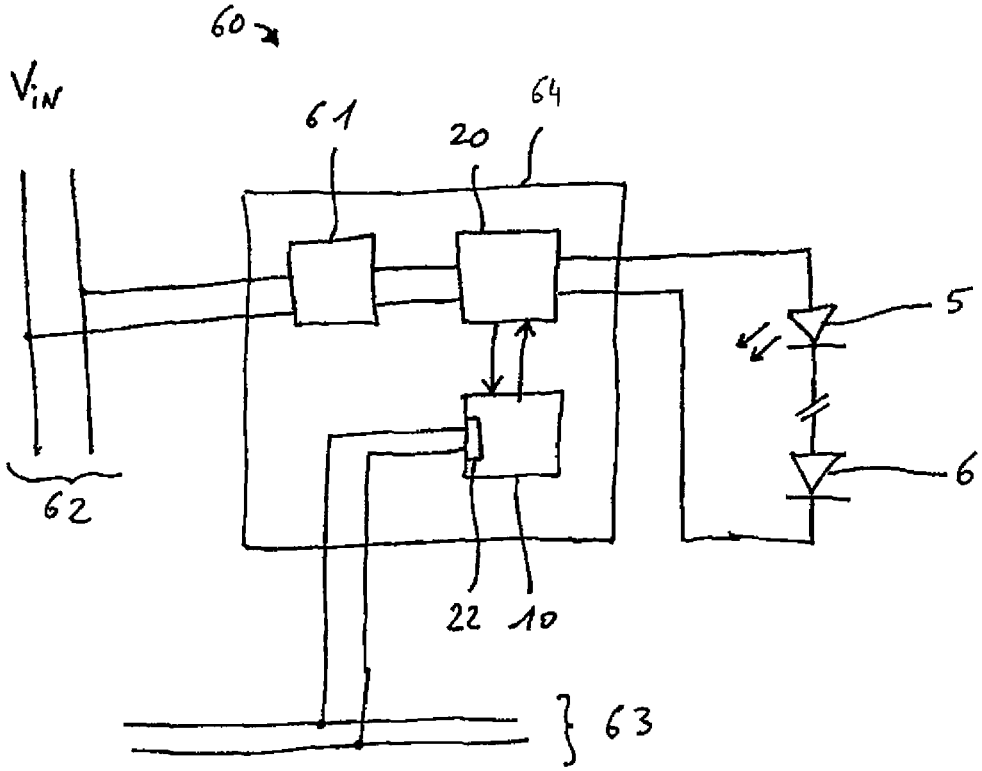
FIG. 7 shows a lighting system in accordance with the present invention.

FIG. 7 shows a lighting system 60 in accordance with the present invention. The lighting system 60 preferably comprises an operating circuit 64 for light-emitting diodes 5, 6. The operating circuit 64 has a buck converter 20 in accordance with the first exemplary embodiment shown in FIG. 1. Alternatively, for example, a buck converter 54 in accordance with the further exemplary embodiment shown in FIG. 6 can also be provided.

The buck converter 20 is connected downstream of an AC-to-DC converter 61, which converts an AC voltage VIN provided by an electrical grid 62 into a rectified voltage or into a DC voltage. Alternatively, the buck converter 20 can also be supplied by an AC voltage.

Dimming values can be communicated to the control unit 10 via the input 22. These dimming values can be fixed, for example, by a central unit (not shown) via a data bus 63. Preferably, the control unit 10 can also transmit data itself, for example with respect to the regulation, back to the central unit via the data bus 63.

For the regulation, feedback variables are made available to the control unit from the region of the operating circuit 64. Depending on the operating mode of the buck converter 20, the control unit 10 adjusts the control parameters as described above. The various control parameter sets can be communicated to the control unit 10, for example via the data bus.

The control algorithm can be implemented in analog or digital form. In particular in the case of a digital implementation, the variation of the properties of the control loop preferably takes place by changing parameters of the digitally implemented regulation. Meanwhile, the change in the properties can also be performed at another point in the control loop, for example by selective switching of, for example, a bandpass filter in the feedback branch of the actual value signal. A switchover of the control loop or of parts of the control loop can also take place.

LIST OF REFERENCE SYMBOLS

1 Switch
2 Diode
3 Inductance
4 Inductance
5 Light-emitting diode
6 Light-emitting diode
7 Resistor
8 Resistor
9 Flipflop circuit
10 Control unit
11 Capacitor
12 Resistor
13 Measuring resistor
15 Capacitor
16 Diode
17 Input of control unit
18 Input of control unit
19 Output of control unit
20 Buck converter
21 Operating circuit
22 Input of control unit for dimming values
50 Comparator
51 Operating circuit
52 Secondary winding
53 Input of control unit
54 Buck converter
60 Lighting system
61 AC-to-DC converter
62 Electrical grid
63 Data bus
64 Operating circuit

What is claimed is:

1. A method for operating at least one light-emitting diode (LED) (5, 6), the method comprising:

providing a switching regulator circuit (20), which is in the form of a buck converter and to which an input voltage (VDC) is supplied, and which provides, by at least one switch (1) which is clocked by a control unit (10), an output voltage (VOUT) for supplying current, voltage or electric power which is constantly regulated at least when averaged over time to the at least one light-emitting diode (5, 6), wherein the setpoint value for the LED current, voltage or power is adjustable for dimming; and varying control parameters of a control loop for the LED current, the LED voltage or the LED power depending on an operating mode of the switching regulator circuit (20) and wherein the adjustment of the control parameters is made dependent on the fact that, in a continuous operating mode of the switching regulator circuit, the steady-state gain (ks1, ks2) is greater than in a discontinuous operating mode.

2. The method as claimed in claim 1, wherein, in the event of a transfer from one operating mode of the switching regulator circuit (20) to another operating mode, the control parameters are changed.

3. The method as claimed in claim 1, wherein the operating mode of the switching regulator circuit (20) is identified and, depending on this, the control parameters are adjusted.

4. The method as claimed in claim 1, wherein different control parameter sets are provided for different operating modes.

5. The method as claimed in claim 1, wherein the switching regulator circuit (20) can be operated in a continuous mode and in a discontinuous mode, and a respective control parameter set is provided for each of these operating modes.

6. The method as claimed in claim 5, wherein the discontinuous operating mode is identified by virtue of the fact that, when the switch (1) is switched off, a reversal of the output voltage (VM) of the switch (1) or a reversal of the voltage drop (VM) across a diode (2) connected downstream of the switch (1) or a reversal of the voltage drop across an energy store (3) of the switching regulator circuit (20) is determined.

7. The method as claimed in claim 5, wherein the discontinuous operating mode is identified by virtue of the fact that, when the switch (1) is switched on, the output voltage (VM) of the switch (1) or the voltage drop (VM) across a diode (2) connected downstream of the switch (1) or the voltage drop across an energy store (3) of the switching regulator circuit (20) is greater than a predetermined value, or is within a specific value range.

8. The method as claimed in claim 7, wherein an operating mode or a transfer between two operating modes is determined by a flipflop circuit (9).

9. An integrated circuit, in the form of a microcontroller, an application-specific integrated circuit (ASIC) or a digital signal processor, for implementing a method as claimed in claim 1.

10. An LED luminaire having an integrated circuit as claimed in claim 9.

11. A method for operating at least one light-emitting diode (LED) (5, 6), the method comprising:

providing a switching regulator circuit (20), which is in the form of a buck converter and to which an input voltage (VDC) is supplied, and which provides, by at least one switch (1) which is clocked by a control unit (10), an output voltage (VOUT) for supplying current, voltage or electric power which is constantly regulated at least when averaged over time to the at least one light-emitting diode (5, 6), wherein the setpoint value for the LED current, voltage or power is adjustable for dimming; and varying control parameters of a control loop for the LED current, the LED voltage or the LED power depending on an operating mode of the switching regulator circuit (20), the switching regulator circuit (20) can be operated in a continuous mode and in a discontinuous mode, and a respective control parameter set is provided for each of these operating modes, the discontinuous operating mode is identified by virtue of the fact that, when the switch (1) is switched on, the output voltage (VM) of the switch (1) or the voltage drop (VM) across a diode (2) connected downstream of the switch (1) or the voltage drop across an energy store (3) of the switching regulator circuit (20) is greater than a predetermined value, or is within a specific value range;

wherein an operating mode or a transfer between two operating modes is determined by a flipflop circuit, the flipflop circuit is configured in the form of a D flipflop circuit (9), wherein:

the clock input of said circuit is fed the control signal generated by the control unit (10) for the switch (1), the D input of said circuit is fed a signal which represents an electrical parameter of the switching regulator circuit, and the output of said circuit is connected to an input (18) of the control unit (10).

12. The method as claimed in claim 11, wherein the signal at the D input of the D flipflop circuit (9) reproduces the output voltage (VM) of the switch (1) of the switching regulator circuit in the form of a buck converter.

13. The method as claimed in claim 11, wherein the control signal for the switch (1) at the clock input is delayed such that the runtimes of the switch driving are compensated for.

14. The method as claimed in claim 11, wherein, in order to identify the operating mode, a comparator (50) is connected at the D input.

* * * * *